US008584495B2

(12) United States Patent
Chiou et al.

(10) Patent No.: US 8,584,495 B2
(45) Date of Patent: Nov. 19, 2013

(54) EXCHANGEABLE CYLINDER LOCK ASSEMBLY

(75) Inventors: Ming-Shyang Chiou, Chiayi (TW); Kuang-I Liao, Tainan (TW)

(73) Assignee: Tong Lung Metal Industry Co., Ltd., Chia-Yi (TW)

( * ) Notice: Subject to any disclaimer, the term of this patent is extended or adjusted under 35 U.S.C. 154(b) by 0 days.

(21) Appl. No.: 13/369,873

(22) Filed: Feb. 9, 2012

(65) Prior Publication Data

US 2012/0204611 A1 Aug. 16, 2012

(30) Foreign Application Priority Data

Feb. 11, 2011 (TW) ..... 100202603 U

(51) Int. Cl.
*E05B 9/04* (2006.01)

(52) U.S. Cl.
USPC ..... 70/371; 70/367; 70/369; 70/375; 70/378; 70/421

(58) Field of Classification Search
USPC ..... 70/367–371, 373, 375, 378, 493, 70/419–421
See application file for complete search history.

(56) References Cited

U.S. PATENT DOCUMENTS

| | | | | |
|---|---|---|---|---|
| 4,282,731 | A * | 8/1981 | Taksony | 70/493 |
| 5,070,715 | A * | 12/1991 | Smallegan et al. | 70/369 |
| 5,507,163 | A * | 4/1996 | Juang | 70/369 |
| 5,979,200 | A * | 11/1999 | Cliff | 70/491 |
| 6,079,240 | A * | 6/2000 | Shvarts | 70/367 |
| 6,523,378 | B2 * | 2/2003 | Kuo | 70/360 |
| 6,578,396 | B2 * | 6/2003 | Field et al. | 70/371 |
| 7,003,994 | B2 * | 2/2006 | Ruan | 70/416 |
| 7,650,769 | B2 * | 1/2010 | Lo | 70/368 |
| 7,681,425 | B2 * | 3/2010 | Teixeira | 70/367 |
| 8,065,897 | B2 * | 11/2011 | Teixeira | 70/367 |
| 8,186,193 | B2 * | 5/2012 | Huang et al. | 70/375 |
| 8,186,194 | B2 * | 5/2012 | Field et al. | 70/491 |
| 8,336,348 | B2 * | 12/2012 | Dalton et al. | 70/337 |
| 8,336,349 | B2 * | 12/2012 | Thimmappa et al. | 70/371 |
| 2005/0011239 | A1 * | 1/2005 | Lurie et al. | 70/369 |
| 2006/0230797 | A1 * | 10/2006 | Strong et al. | 70/371 |
| 2008/0016928 | A1 * | 1/2008 | Yang et al. | 70/367 |
| 2010/0116007 | A1 * | 5/2010 | Thimmappa et al. | 70/91 |
| 2012/0266638 | A1 * | 10/2012 | Rao et al. | 70/369 |

* cited by examiner

*Primary Examiner* — Suzanne Barrett
(74) *Attorney, Agent, or Firm* — Hamre, Schumann, Mueller & Larson, P.C.

(57) ABSTRACT

An exchangeable cylinder lock includes a plug shell connected to a pin chest. A locking pin is disposed in a radial pin hole in the pin chest and is biased to protrude from an aperture in a cover plate and to engage a lock housing. The locking pin is depressable to retract for disengaging from the lock housing. A locking ring is disposed around the plug proximate to the locking pin, and has at least one indentation. When the plug is rotated using a right key, the locking ring can be rotated to align the indentation with the locking pin so as to permit depression of the locking pin, or to move the indentation away from the locking pin so as to prevent depression of the locking pin.

14 Claims, 6 Drawing Sheets

EXCHANGEABLE CYLINDER LOCK ASSEMBLY

CROSS-REFERENCE TO RELATED APPLICATION

This application claims priority of Taiwanese Patent Application No. 100202603 filed on Feb. 11, 2011.

BACKGROUND OF THE INVENTION

1. Field of the Invention

The invention relates to an exchangeable cylinder lock, and more particularly to an exchangeable cylinder lock that can be mounted removably inside a lock housing coupled to an operating knob or lever handle.

2. Description of the Related Art

Various forms of exchangeable cylinder locks have existed in the art. One form of the cylinder locks is disclosed in U.S. Pat. No. 5,070,715, and includes a cylindrical outer shell receiving a key plug and connected to a pin chest. The cylindrical outer shell and the pin chest are mounted removably inside a lock housing. The pin chest has a transverse bore receiving a locking pin means for engagement in a recess in the housing, and a locking pin stop latch means for preventing retraction of the locking pin means. The exchangeable cylinder lock further includes a control pin means disposed within the key plug, an actuating ring concentric with the key plug, and an actuating pin to operate the locking pin means and the locking pin stop latch means. The construction of the aforesaid cylinder lock is complicated, and the manufacture thereof is costly due to a number of component parts required to retain the cylinder lock in the housing and to permit removal and replacement of the cylinder lock. Some other forms of the exchangeable cylinder lock are suggested in U.S. Pat. Nos. 7,650,769 and 6,718,807.

SUMMARY OF THE INVENTION

A main object of the present invention is to provide an improved exchangeable cylinder lock with a simple construction that is easy for assembly and inexpensive to manufacture.

According to one aspect of the invention, an exchangeable cylinder lock, which can be mounted removably in a lock housing, comprises an outer shell, a plug, first and second tumbler pins, a cover plate, a locking pin, and a locking ring.

The outer shell has a plug shell defining a cylindrical hole, and a pin chest connected to the plug shell. The pin chest includes a first pin hole and a second pin hole, both of which extend along a radial direction of the cylindrical hole. The plug is disposed in the cylindrical hole, and has a third pin hole that can be aligned with the second pin hole. First and second tumbler pins are respectively disposed in the second and third pin holes. The cover plate is disposed on the pin chest to cover the first and second pin holes and has an aperture aligned with the first pin hole. A locking pin is disposed in the first pin hole and is biased to protrude out of the aperture for engaging the lock housing. The locking pin is depressable to retract for disengaging from the lock housing. The locking ring is disposed around the plug proximate to the first pin hole and is rotatable together with the plug. The locking ring has an inner periphery engaging the plug, and an outer periphery capable of abutting against the locking pin. The outer periphery has at least one indentation.

When the plug is rotated using a right key, the locking ring can be moved to a non-blocking position, in which the indentation is aligned with the locking pin to permit depression of the locking pin, or to a blocking position, in which the indentation is moved away from the locking pin to prevent depression of the locking pin.

According to another aspect of the invention, an exchangeable cylinder lock that can be mounted removably in a lock housing comprises an outer shell, a plug, a locking pin, and a locking ring. The outer shell is adapted to be disposed inside the lock housing, and includes a cylindrical hole, and a first pin hole spaced apart from the cylindrical hole. The plug is disposed rotatably in the cylindrical hole. The locking pin is disposed in the first pin hole and extends substantially in a radial direction of the plug. The locking pin has one end biased to protrude out of the first pin hole for engagement with the lock housing. The locking pin is depressable to retract and disengage the one end from the lock housing. The locking ring is disposed around the plug and is rotatable together with the plug. The locking ring has an inner periphery engaging the plug, and an outer periphery capable of abutting against another end of the locking pin. The outer periphery has at least one indentation.

When the plug is rotated using a right key, the locking ring can be moved to a non-blocking position, in which the indentation is aligned with the locking pin to permit depression of the locking pin, or to a blocking position, in which the indentation is moved away from the locking pin to prevent depression of the locking pin.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
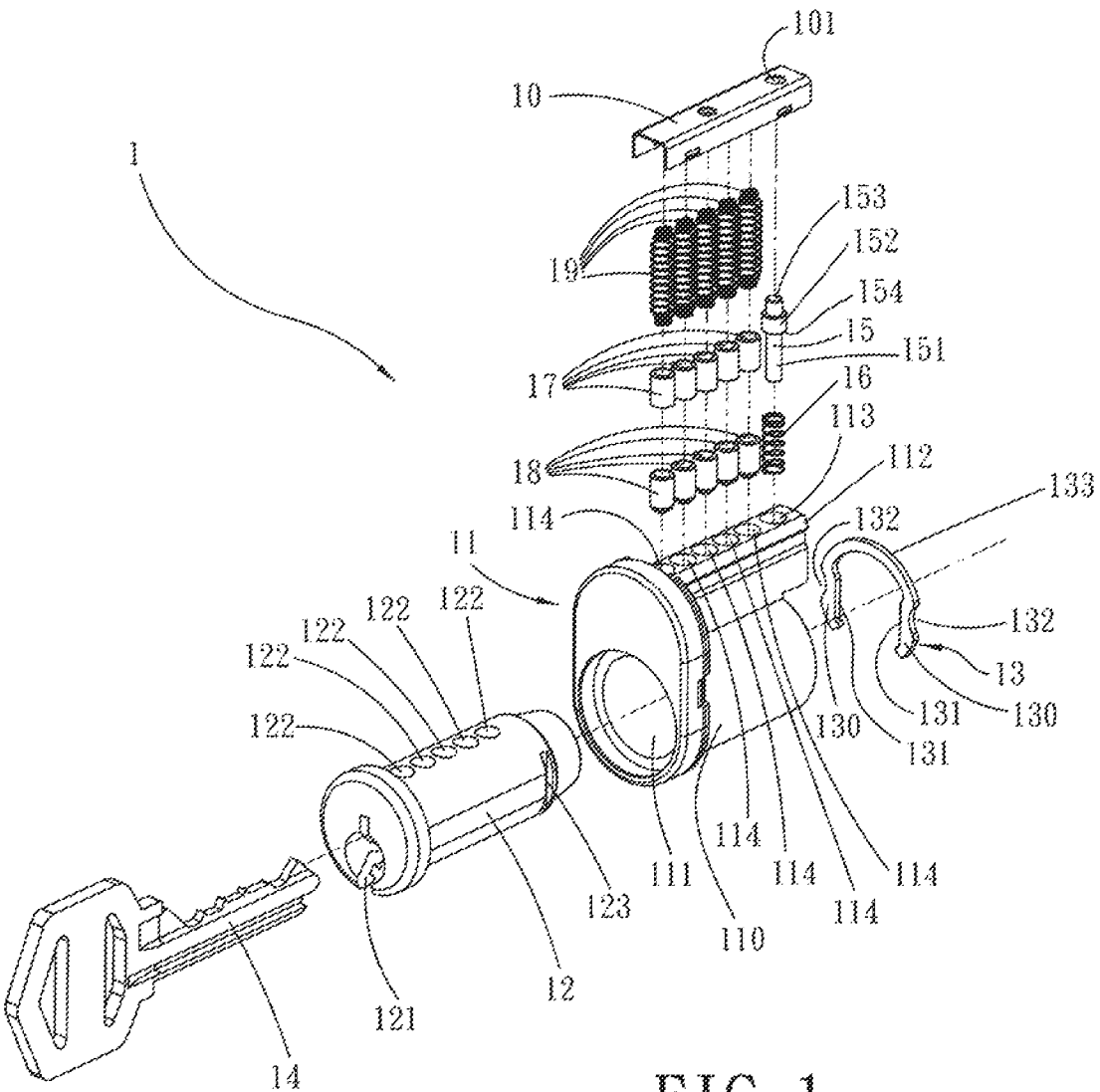
FIG. 1 is an exploded view of an exchangeable cylinder lock according to the present invention.
Figure 2:
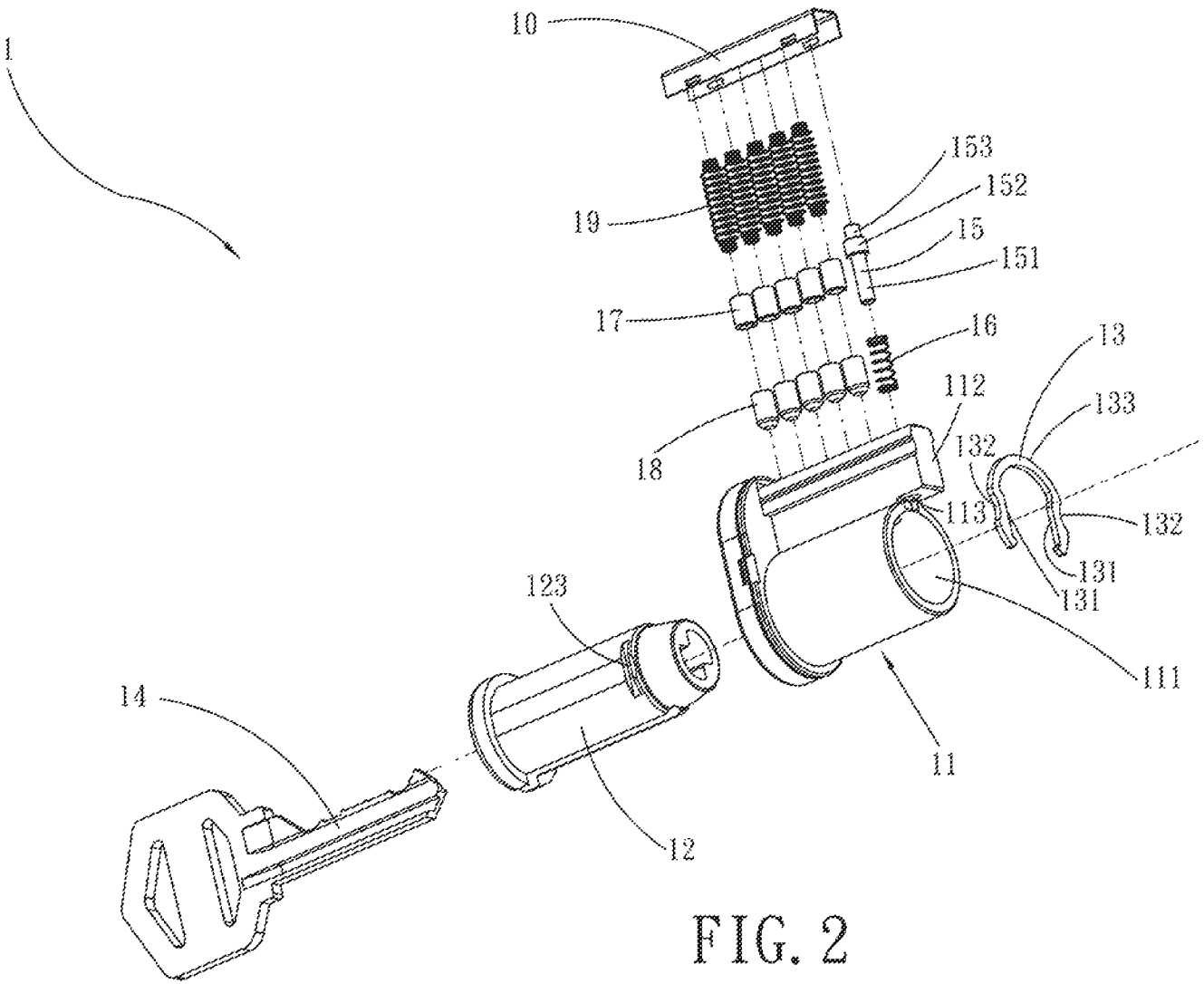
FIG. 2 is another exploded view of the exchangeable cylinder lock according to the present invention.
Figure 3:
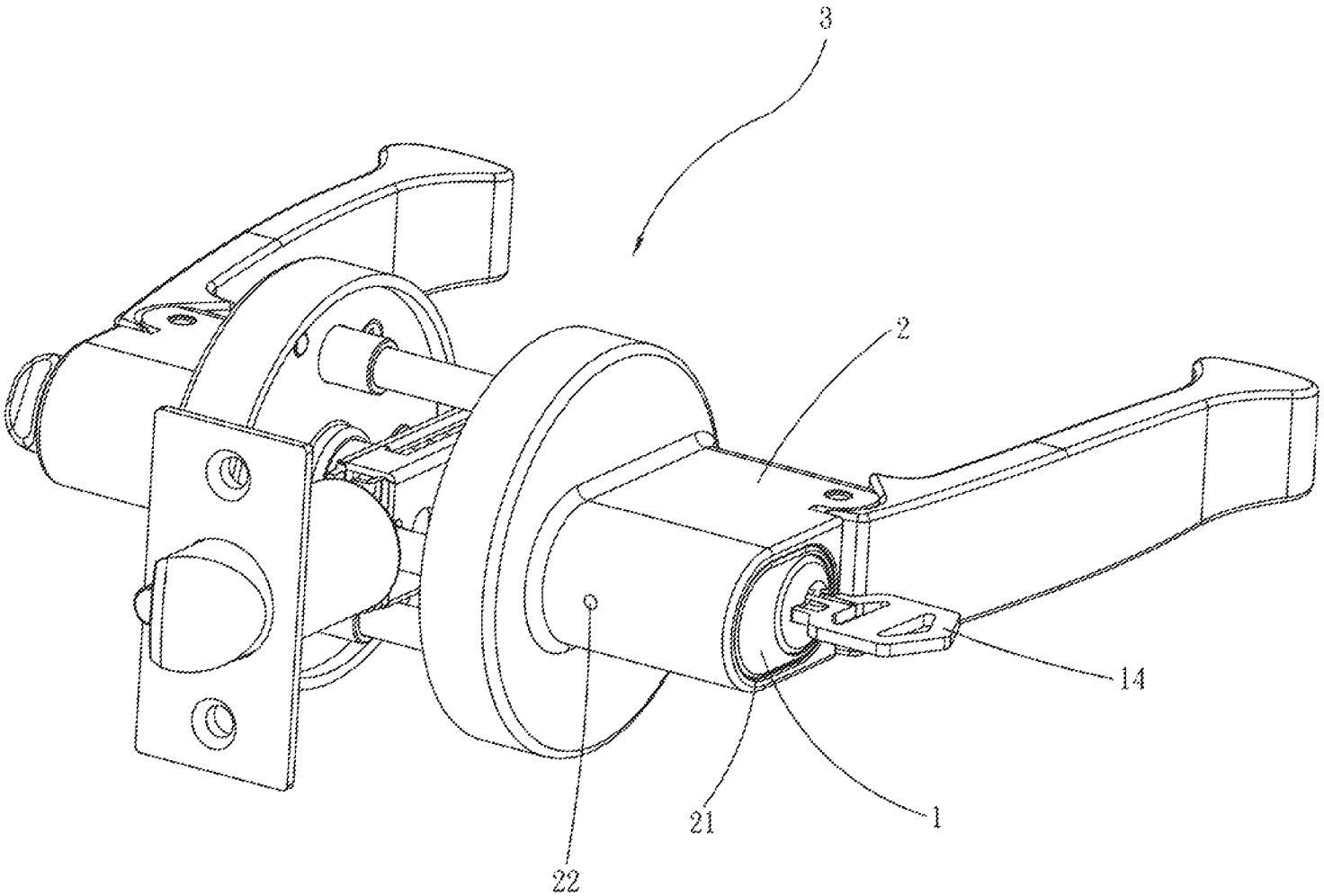
FIG. 3 is a perspective view of a door lock assembly incorporating the exchangeable cylinder lock of FIG. 1.
Figure 4:
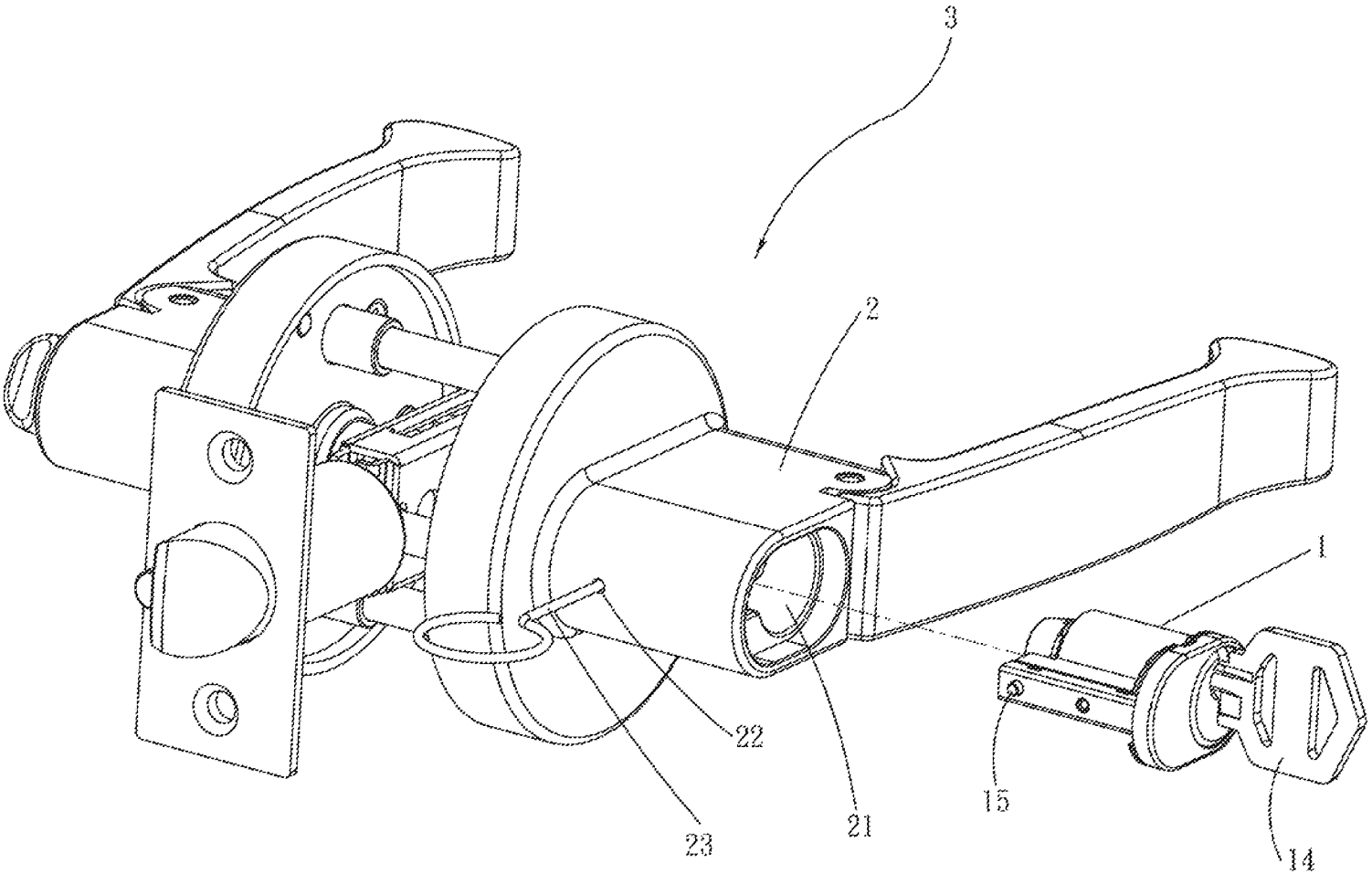
FIG. 4 is the same view as FIG. 3 but illustrating that the exchangeable cylinder lock is removed.
Figure 6:
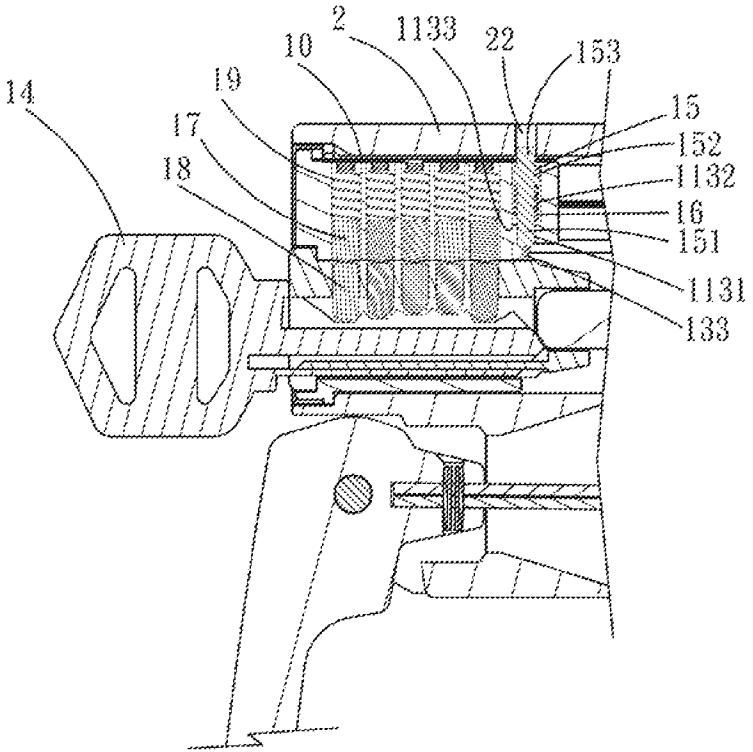
FIG. 6 is a sectional view of the exchangeable cylinder lock.

Referring to FIGS. 1 to 4, there is shown an exchangeable cylinder lock 1 that can be mounted removably in a lock housing 2 of a lock assembly 3. The exchangeable cylinder lock 1 includes an outer shell 11 that has a plug shell 110 defining a cylindrical hole 111, and a pin chest 112 connected to the plug shell 110. The pin chest 112 includes a first pin hole 113 spaced apart from the cylindrical hole 111, and a plurality of second pin holes 114 communicated with the cylindrical hole 111. The first pin hole 113 and the second pin holes 114 are substantially parallel and extend along a radial direction of the cylindrical hole 111. The first pin hole 113 has a first hole section 1131, a second hole section 1132 larger in cross section than the first hole section 1131, and a hole shoulder face 1133 (see FIG. 6) formed between the first and second hole sections 1131, 1132.

A plug 12 is disposed rotatably in the cylindrical hole 111 of the plug shell 110, and includes a key hole 121, and a plurality of third pin holes 122 that are communicated with the keyhole 121 and that can be aligned radially and respectively with the second pin holes 114. An end portion of the plug 12 opposite to an opening of the key hole 121 is formed with two diametrically opposite engaging grooves 123 in an outer circumferential surface thereof.

First tumbler pins 17 are disposed respectively in the second pin holes 114. Springs 19 are inserted respectively in the second pin holes 114 to urge the respective first tumbler pins 17. Second tumbler pins 18 are respectively disposed in the third pin holes 122.

A cover plate 10 is disposed on the pin chest 112 oppositely of the plug shell 110 to cover the first and second pin holes 113 and 114. The cover plate 10 has an aperture 101 aligned with the first pin hole 113. The aperture 101 is smaller in cross section than the second hole section 1132 of the first pin hole 113.

A locking pin 15 is disposed in the first pin hole 113 and is able to protrude out of the aperture 101 for engaging the lock housing 2. The first pin 15 has first, second, and third pin sections 151, 152, 153. The second pin section 152 is intermediate between and larger in cross section than the first and third pin sections 151, 153. The first pin section 151 extends partially into the first hole section 1131 of the first pin hole 113. The second and third pin sections 152, 153 are disposed in the second hole section 1132. A pin shoulder face 154 is formed between the first and second pin section 151, 152. The second hole section 1132 is proximate to the aperture 101 in the cover plate 10. A biasing spring 16 is sleeved around the first pin section 151 in the second hole section 1132 between the pin shoulder face 154 (FIG. 1) and the hole shoulder face 1133 (FIG. 6) of the first pin hole 113 so that the third pin section 153 can protrude out of the aperture 101 to engage the lock housing 2. The locking pin 15 is depressable to retract the third pin section 153 into the pin chest 112 for disengaging from the lock housing 2.

The locking ring 13 is disposed around the end portion of the plug 12 having the engaging grooves 123. The locking ring 13 is proximate to the first hole section 1131 of the first pin hole 113 and is capable of abutting against the first pin section 151 of the locking pin 15. The locking ring 13 has an inner periphery engaging the engaging grooves 123 of the plug 12, and an outer periphery to abut against the locking pin 15. Preferably, the locking ring 13 is formed as a substantially C-shape, and has two opposite end sections 130, an intermediate section 133 between the end sections 130, two diametrically opposite engaging parts 131 formed on the inner periphery of the locking ring 13 respectively at the end sections 130, and two diametrically opposite indentations 132 formed on the outer periphery of the locking ring 13 respectively at the end sections 130. The outer periphery of the locking ring 13 is convex at the intermediate section 133. While two indentations 132 are provided in the embodiment, the number of the indentations 132 should not be limited only thereto. The present invention may be implemented using one indentation 132.

The engaging parts 131 of the locking ring 13 are respectively engaged in the engaging grooves 123 of the plug 12. Preferably, each engaging part 131 is configured to have a substantially straight edge. Each engaging groove 123 of the plug 12 is configured to have a substantially flat groove bottom to abut against the straight edge of the corresponding engaging part 131. Accordingly, the plug 12 has anon-circular cross section portion along a plane passing through the engaging grooves 123, and the locking ring 13 engages the non-circular cross section portion of the plug 12.

Figure 5:
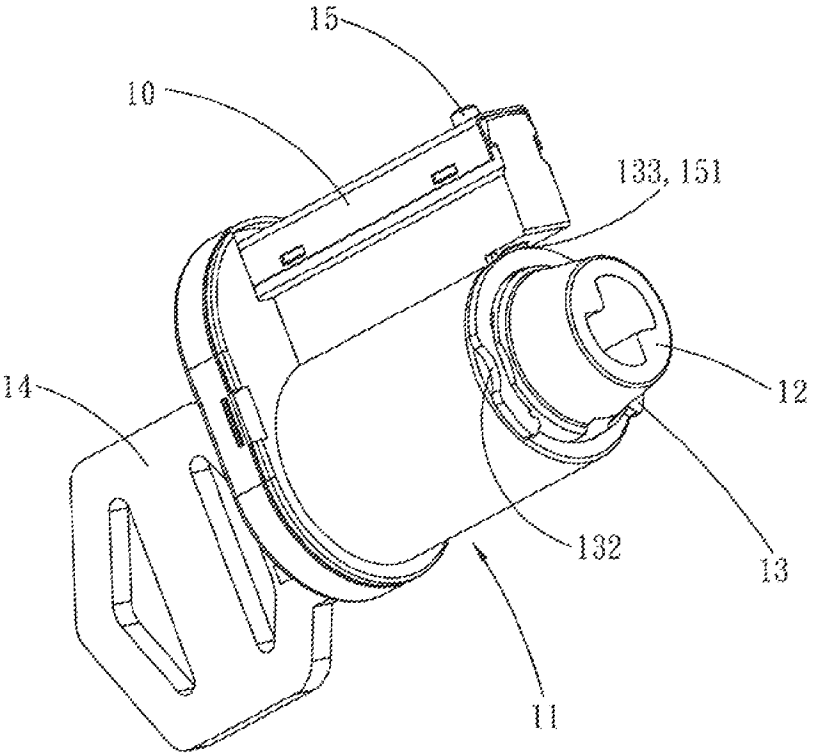
FIG. 5 is a perspective view of the exchangeable cylinder lock.
Figure 8:
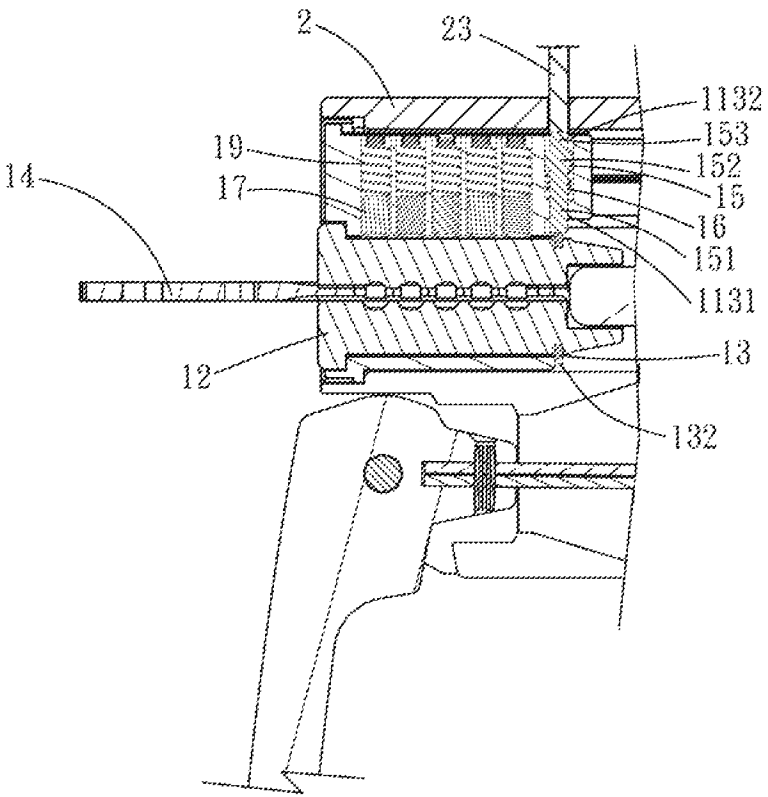
FIG. 8 is the same view as FIG. 6 but illustrating that the locking ring of the exchangeable cylinder lock is in a non-blocking position.
Figure 7:
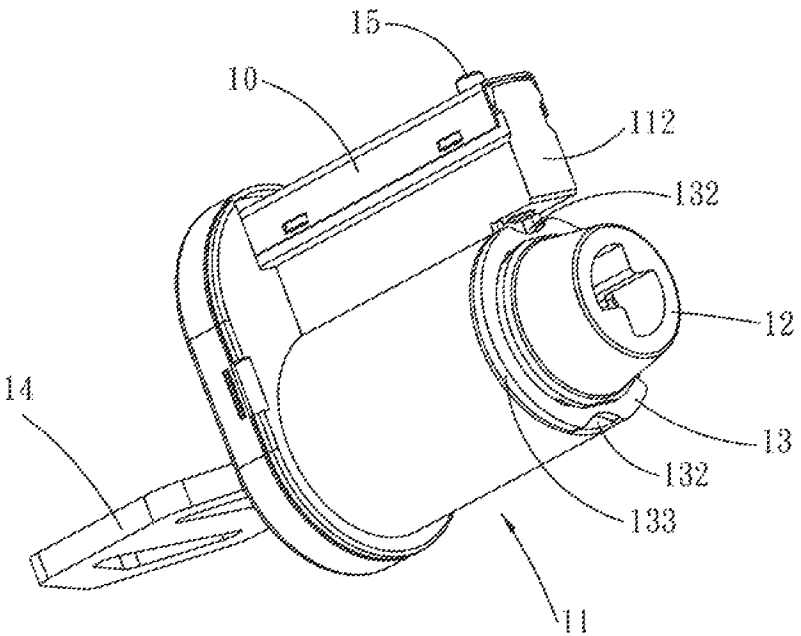
FIG. 7 is the same view as FIG. 5 but illustrating that a locking ring of the exchangeable cylinder lock is in a non-blocking position.

The locations of the indentations 132 are spaced apart from that of the third pin holes 122 of the plug 12 in a circumferential direction by an angle of about 90°. When the plug 12 is rotated using a right key 14, the locking ring 13 can be moved to a non-blocking position or a blocking position. In the non-blocking position, one of the indentations 132 is aligned with the locking pin 15 so that the third pin section 153 can be depressed into the pin chest 112 (see FIGS. 7 and 8) and the locking pin 15 can extend into the indentation 132. In the blocking position, the indentation 132 is moved away from the locking pin 15 and the convex intermediate section 133 abuts against the locking pin 15 (see FIGS. 5 and 6) so that depression of the locking pin 15 is not permitted.

The lock housing 2 has a receiving hole 21 to receive the exchangeable cylinder lock 1, and a slot 22 communicated with the receiving hole 21. When the cylinder lock 1 is mounted properly inside the lock housing 2, the third pin section 153 of the locking pin 15 engages the slot 22.

Referring to FIGS. 3 to 8, when a right key 19 is inserted into a key hole 121 to rotate the plug 12 by an angle of 90°, one of the indentations 132 in the locking ring 13 is moved to and aligned with the first pin hole 113 and the first pin section 151 of the locking pin 15. At this state, the third pin section 153 of the locking pin 15 may be depressed for retraction into the pin chest 112, and the cylinder lock 1 may be inserted into the receiving space 21 of the lock housing 2. When the first pin hole 113 reaches the slot 22, the third pin section 153 extends into the slot 22 by the biasing action of the spring 16. Accordingly, the cylinder lock 1 is locked within the lock housing 2. When the plug 12 is rotated to its original position using the key 14, the indentations 132 are moved away from the first pinhole 113, and the first pin section 151 of the locking pin 15 abuts against the convex surface of the intermediate section 133 of the locking ring 13. At this state, the locking pin 15 cannot be depressed. Removal of the cylinder lock 1 froth the lock housing 2 is thus prevented.

When it is necessary to remove the cylinder lock 1 from the lock housing 2, the plug 12 must be rotated by 90° from the original position using the right key 14 so that one of the indentations 132 of the locking ring 13 is aligned with the locking pin 15. A rod piece 23 may be inserted into the slot 22 to depress the locking pin 15. At this state, the locking pin 15 is moved into and engaged with the indentation 132 of the locking ring 13. As a result, the locking pin 15 is disengaged from the lock housing 2, and the plug is prevented from rotation. The cylinder lock 1 can therefore be removed from the locking housing 2.

As described above, the cylinder lock 1 according to the present invention can be quickly removed from or attached to the lock housing 2. Because the cylinder lock 1 has a simple construction, it can be assembled easily, and the manufacturing cost thereof is low.

While the present invention has been described in connection with what is considered the most practical and preferred embodiments, it is understood that this invention is not limited to the disclosed embodiment but is intended to cover various arrangements included within the spirit and scope of the broadest interpretation so as to encompass all such modifications and equivalent arrangements.

What is claimed is:

1. An exchangeable cylinder lock that can be mounted removably in a lock housing, comprising:

an outer shell having a plug shell defining a cylindrical hole, and a pin chest connected to said plug shell, said pin chest including a first pin hole and a second pin hole, both of which extend along a radial direction of said cylindrical hole;

a plug disposed inside said cylindrical hole, and having a third pin hole that can be aligned with said second pin hole;

first and second tumbler pins respectively disposed in said second and third pin holes;

a cover plate disposed on said pin chest to cover said first and second pin holes, said cover plate having an aperture aligned with said first pin hole;

a locking pin disposed in said first pin hole and biased to protrude out of said aperture for engaging the lock housing, said locking pin being depressable to retract for disengaging from the lock housing; and a locking ring disposed around said plug proximate to said first pin hole and rotatable together with said plug, said locking ring having an inner periphery engaging said plug, and an outer periphery capable of abutting against said locking pin, said outer periphery having at least one indentation;

wherein, when said plug is rotated using a right key, said locking ring can be moved to a non-blocking position, in which said indentation is aligned with said locking pin to permit depression of said locking pin, or to a blocking position, in which said indentation is moved away from said locking pin to prevent depression of said locking pin.

2. The exchangeable cylinder lock of claim 1, further comprising a biasing spring disposed around said locking pin within said first pin hole.

3. The exchangeable cylinder lock of claim 2, wherein said first pin hole has a first hole section, a second hole section larger in cross section than said first hole section, and a hole shoulder face between said stepped and having a pin shoulder face, said biasing spring being disposed in said second hole section between said hole shoulder face and said pin shoulder face.

4. The exchangeable cylinder lock of claim 3, wherein said first hole section is proximate to said locking ring, said second hole section being proximate to said cover plate, said aperture being smaller in cross section than said second hole section.

5. The exchangeable cylinder lock of claim 4, wherein said locking pin has first, second, and third pin sections, said second pin section being intermediate between and larger in cross section than said first and third pin sections, said first pin section partially extending into said first hole section, said pin shoulder face being formed between said first and second pin sections, said second and third pin sections being disposed in said second hole section, said biasing spring being disposed around said first pin section.

6. The exchangeable cylinder lock of claim 1, wherein said indentation is disposed at a position which is spaced apart from said third pin hole in a circumferential direction by an angle of about 90°.

7. The exchangeable cylinder lock of claim 1, wherein said plug has at least one engaging groove that is indented from an outer circumferential surface of said plug, said inner periphery of said locking ring having an engaging part engaged in said engaging groove.

8. The exchangeable cylinder lock of claim 1, wherein said plug has two diametrically opposite engaging grooves that are indented from an outer circumferential surface of said plug, said inner periphery of said locking ring having two diametrically opposite engaging parts respectively engaged in said engaging grooves.

9. The exchangeable cylinder lock of claim 8, wherein said locking ring is formed as a substantially c-shape, and has two opposite end sections, and an intermediate section between said end sections, said inner periphery of said locking ring having said engaging parts formed at said end sections, respectively, said outer periphery of said locking ring being convex at said intermediate section and having said indentations formed at said end sections, respectively.

10. The exchangeable cylinder lock of claim 9, wherein each of said engaging parts has a substantially straight edge, each of said engaging grooves having a substantially flat groove bottom to abut against said straight edge.

11. An exchangeable lock assembly comprising:

a plug shell having a cylindrical hole;

a pin chest connected to said plug shell and including a first pin hole and a second pin hole, both of which extend along a radial direction of said cylindrical hole;

a plug disposed in said cylindrical hole, and having a third pin hole that can be aligned with said second pin hole;

first and second tumbler pins respectively disposed in said second and third pin holes;

a cover plate disposed on said pin chest to cover said first and second pin holes, said cover plate having an aperture aligned with said first pin hole;

a lock housing receiving said plug shell and said pin chest, and having a slot aligned with said aperture;

a locking pin disposed in said first pin hole and biased to protrude out of said aperture for engagement with said slot of said lock housing, said locking pin being depressable to retract for disengaging from said lock housing; and a locking ring disposed around said plug proximate to said first pin hole and rotatable together with said plug, said locking ring having an inner periphery engaging said plug, and an outer periphery capable of abutting against said locking pin, said outer periphery having at least one indentation;

wherein, when said plug is rotated using a right key, said locking ring can be moved to a non-blocking position, in which said indentation is aligned with said locking pin to permit depression of said locking pin, or to a blocking position, in which said indentation is moved away from said locking pin to prevent depression of said locking pin.

12. An exchangeable cylinder lock that can be mounted removably in a lock housing, comprising:

an outer shell adapted to be disposed inside said lock housing, and including a cylindrical hole, and a first pin hole spaced apart from said cylindrical hole;

a plug disposed rotatably in said cylindrical hole;

a locking pin disposed in said first pin hole and extending substantially in a radial direction of said plug, said locking pin having one end biased to protrude out of said first pin hole for engagement with the lock housing, said locking pin being depressable to retract and disengage from said lock housing; and a locking ring disposed around said plug and rotatable together with said plug, said locking ring having an inner periphery engaging said plug, and an outer periphery capable of abutting against another end of said locking pin, said outer periphery having at least one indentation, wherein, when said plug is rotated using a right key, said locking ring can be moved to a non-blocking position, in which said indentation is aligned with said locking pin to permit depression of said locking pin, or to a blocking position, in which said indentation is moved away from said locking pin to prevent depression of said locking pin, and wherein said plug has an engaging groove that is indented from an outer circumferential surface of said plug and that has a flat groove bottom, and said inner periphery of said locking ring is a substantially straight engaging part extending into said engaging groove and abutting against said flat groove bottom.

13. The exchangeable cylinder lock of claim 12, wherein said locking ring is formed as a substantially C-shape, and has two opposite end sections, and an intermediate section between said end sections, said inner periphery of said locking ring having two said engaging parts formed at said end sections, respectively.

14. The exchangeable cylinder lock of claim 13, wherein, said outer periphery of said locking ring is convex at said intermediate section and has two said indentations formed at said end sections, respectively.

* * * * *